US005567168A

United States Patent [19]

Marsh et al.

[11] Patent Number: 5,567,168

[45] **Date of Patent: *Oct. 22, 1996**

[54] ELECTRICAL CONNECTOR HAVING ELECTROSTATIC DISCHARGE PROTECTION

[75] Inventors: Edward K. Marsh, Kernersville, N.C.; Richard A. Nelson, Glen Ellyn, Ill.; Earl W. McCleerey; George R. DeFibaugh, both of Mechanicsburg, Pa.; Gary J. Verdun, Houston, Tex.

[73] Assignees: The Whitaker Corporation, Wilmington, Del.; Compao Computer Corporation, Houston, Tex.

[ * ] Notice: The term of this patent shall not extend beyond the expiration date of Pat. No. 5,567,169.

[21] Appl. No.: 994,669

[22] Filed: Dec. 22, 1992

Related U.S. Application Data

[63] Continuation of Ser. No. 836,155, Feb. 13, 1992, abandoned, and a continuation-in-part of Ser. No. 977,800, Nov. 17, 1992, which is a continuation of Ser. No. 947,079, Sep. 17, 1992, abandoned, which is a continuation of Ser. No. 771,871, Oct. 1, 1991, abandoned, which is a continuation of Ser. No. 589,143, Sep. 27, 1990, abandoned, said Ser. No. 836,155, Feb. 13, 1992, abandoned, is a continuation of Ser. No. 658,135, Feb. 20, 1991, abandoned.

[51] Int. Cl.[6] ..... H01R 13/53

[52] U.S. Cl. ..... 439/181; 439/607

[58] Field of Search ..... 439/92, 95, 101, 439/108, 181, 186, 187, 607–610

[56] References Cited

U.S. PATENT DOCUMENTS

| | | | |
|---|---|---|---|
| 3,148,929 | 9/1964 | Gordon . | |
| 3,395,377 | 7/1968 | Straus . | |
| 3,692,966 | 9/1972 | Lancaster | 200/51.1 |
| 3,760,335 | 9/1973 | Roberts . | |
| 3,963,300 | 6/1976 | Patton et al. . | |
| 4,179,178 | 12/1979 | Bachman et al. . | |
| 4,392,705 | 7/1983 | Andrews et al. . | |
| 4,418,972 | 12/1983 | Benasutti . | |
| 4,456,800 | 6/1984 | Holland | 200/5 A |
| 4,458,291 | 7/1984 | Yanagisawa et al. . | |
| 4,477,134 | 10/1984 | Wright . | |
| 4,531,176 | 7/1985 | Beecher, II . | |
| 4,532,419 | 7/1985 | Takeda | 235/492 |
| 4,568,133 | 2/1986 | Amano et al. . | |
| 4,597,631 | 7/1986 | Flores | 350/96.20 |
| 4,673,236 | 6/1987 | Musolff et al. | 439/609 |
| 4,688,868 | 8/1987 | Noyes | 439/108 |
| 4,692,121 | 9/1987 | Arbogast, Jr. | 439/874 |
| 4,697,864 | 10/1987 | Hayes et al. | 439/444 |
| 4,699,438 | 10/1987 | Kikuta | 439/95 |
| 4,705,339 | 11/1987 | Hayes et al. | 439/277 |
| 4,711,506 | 12/1987 | Tanaka | 439/108 |
| 4,731,031 | 3/1988 | Lemke | 439/76 |
| 4,737,116 | 4/1988 | Slye et al. | 439/92 |

(List continued on next page.)

OTHER PUBLICATIONS

AMP Drawing 747481 of a receptacle assembly, dated (approved) Apr. 25, 1984.

*Primary Examiner*—Gary F. Paumen
*Attorney, Agent, or Firm*—Brinks, Hofer, Gilson & Lione

[57] ABSTRACT

Mating plug and receptacle connectors each include electrically insulating housings and plural rows of electrical terminals. The plug connector includes two terminal supporting walls or platforms extending outwardly from the housing with terminal contact portions positioned in channels on the terminal support platforms. Each platform includes at an end thereof a groove which receives a grounding strip in the form of a drain wire, commoned to an outer shielding shell. The receptacle connector has an insulating housing having two elongate slots thereacross, adapted for receiving the terminal support walls of the plug connector, and receptacle contacts for mating engagement with the plug connector terminals. The receptacle housing includes a groove in the front face carrying a grounding strip commoned to an outer shielding shell. The plug and receptacle are matable with their respective shielding shells in mating contact with each other.

16 Claims, 19 Drawing Sheets

U.S. PATENT DOCUMENTS

| | | | |
|---|---|---|---|
| 4,743,080 | 5/1988 | Siraty | 439/492 |
| 4,767,350 | 8/1988 | Cooper et al. | 439/271 |
| 4,773,878 | 9/1988 | Hansel, III | 439/497 |
| 4,806,109 | 2/1989 | Manabe et al. | 439/108 |
| 4,824,377 | 4/1989 | De Burro | 439/186 |
| 4,824,383 | 4/1989 | Lemke | 439/108 |
| 4,889,497 | 12/1989 | Riches | 439/76 |
| 4,889,502 | 12/1989 | Althouse et al. | 439/607 |
| 4,906,208 | 3/1990 | Nakamura et al. | 439/607 |
| 5,030,140 | 7/1991 | Sugiyama | 439/607 |
| 5,064,391 | 11/1991 | Buchter | 439/733 |
| 5,066,240 | 11/1991 | Verdun | 439/181 |
| 5,085,601 | 2/1992 | Buchter et al. | 439/660 |

10
60b
62b
24
60
62

70
72
20

90
24
92
18
30d
34
30
32
60a
62a
38
28
26
62d
60d
6
6
60
62
30c
14
20
12
4
90
22
16
10
92

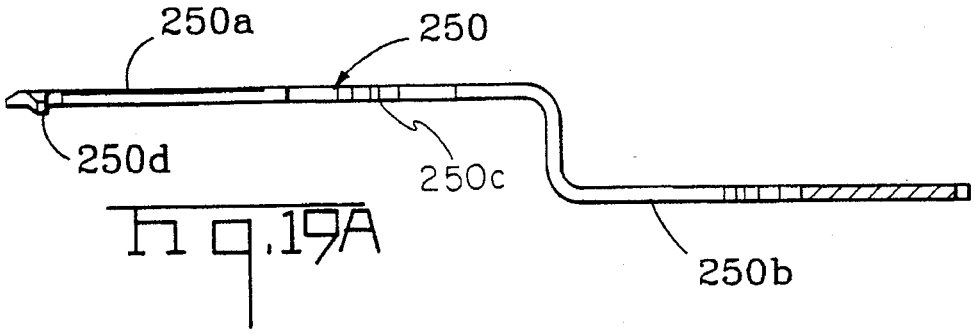
Fig.19A
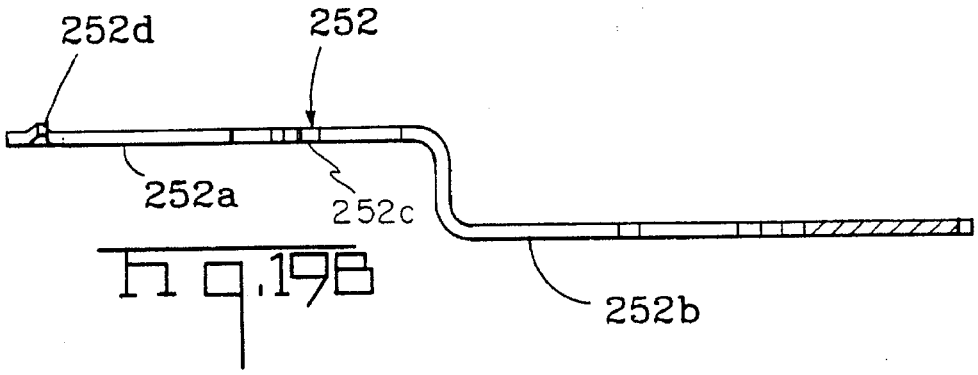
Fig.19B
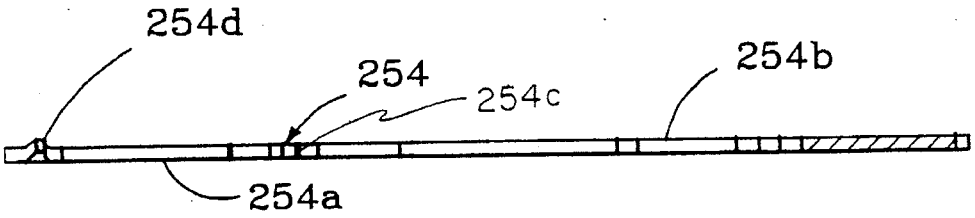
Fig.19C
Fig.20
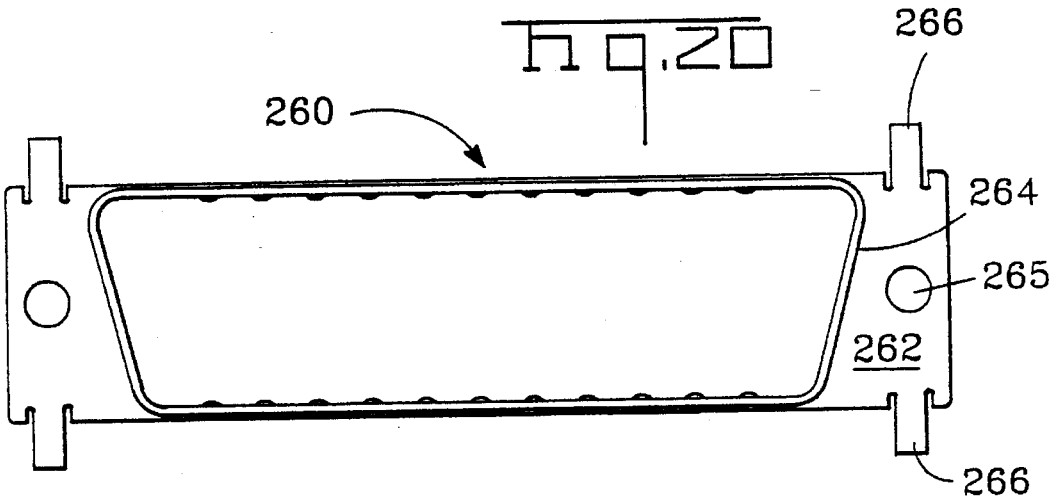

Fig. 30
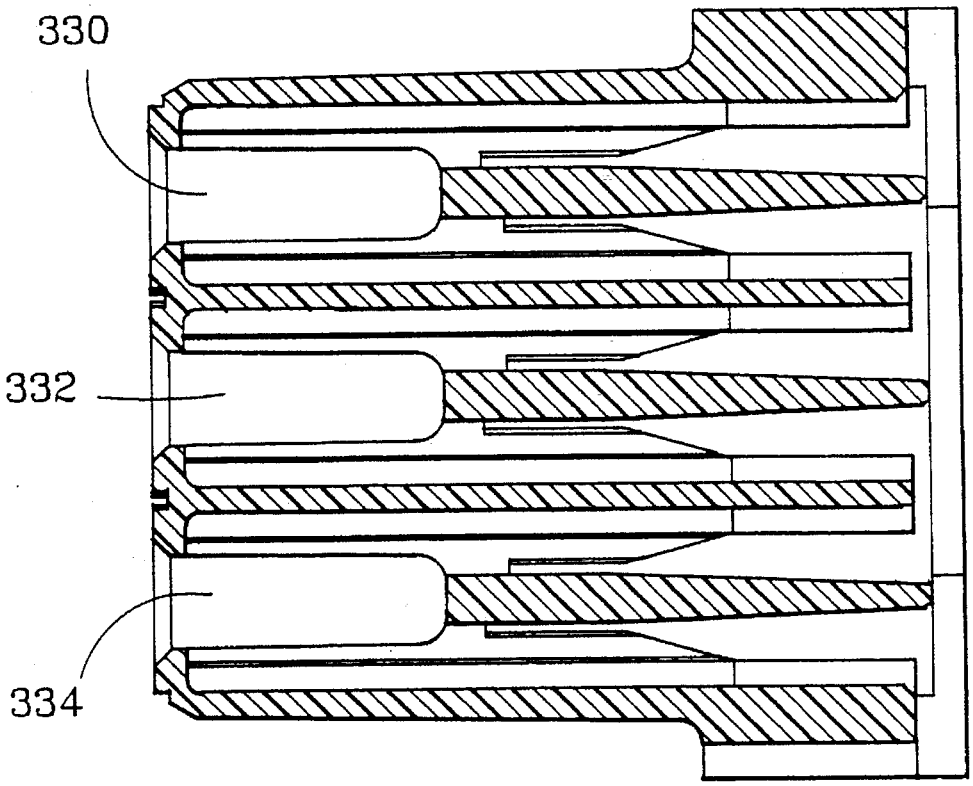
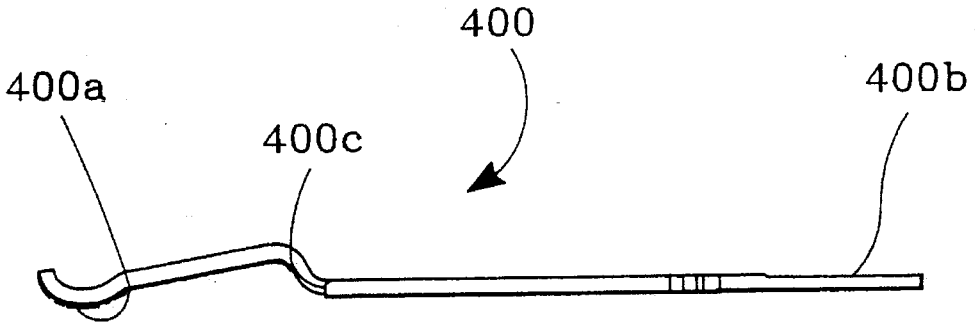
Fig. 31

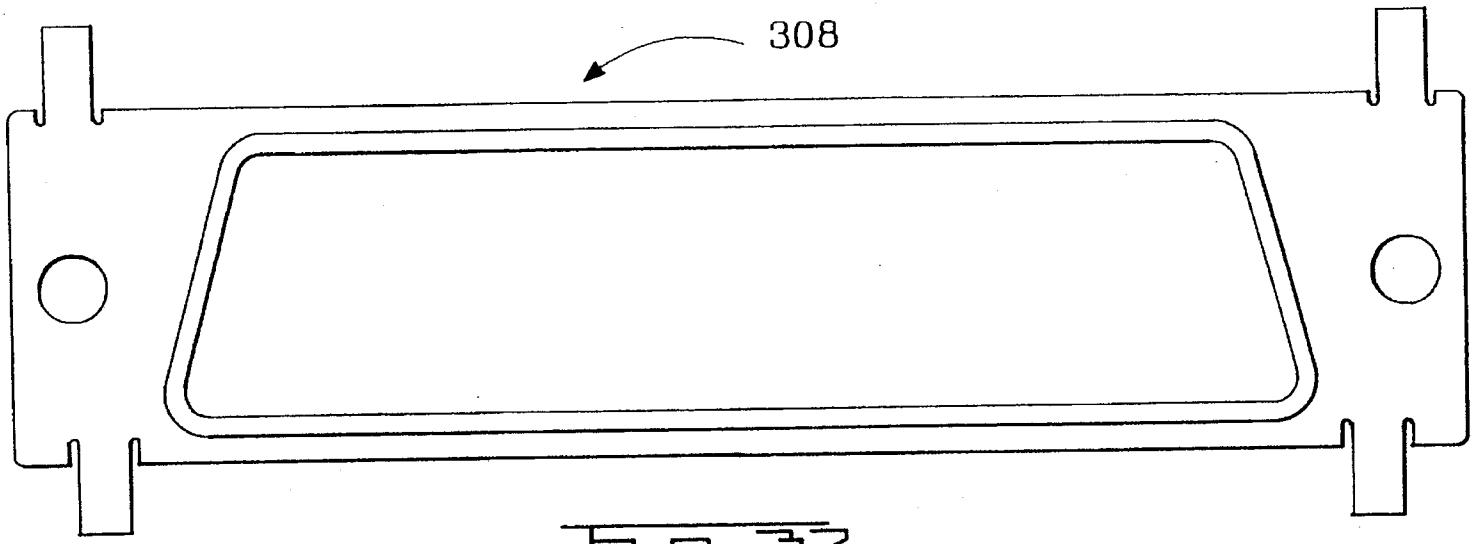
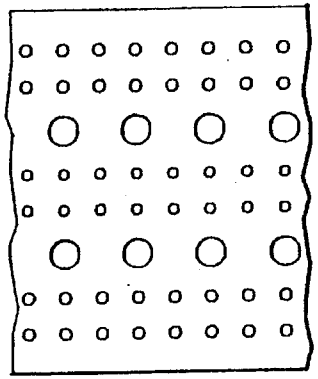
Fig. 27
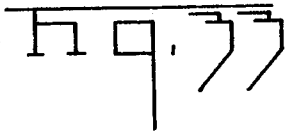
Fig. 28
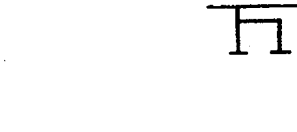
Fig. 29
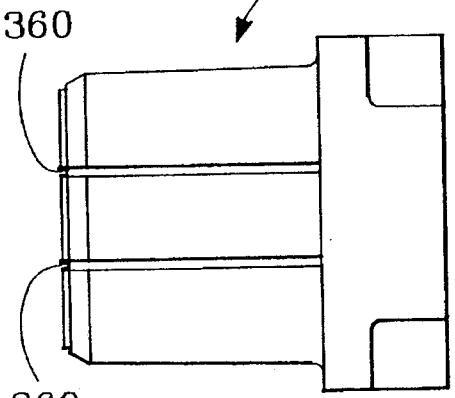

ELECTRICAL CONNECTOR HAVING ELECTROSTATIC DISCHARGE PROTECTION

CROSS-REFERENCE TO RELATED APPLICATIONS

This is continuation of copending application Ser. No. 07/836,155, filed Feb. 13, 1992, by Edward K. Marsh and Richard A. Nelson, abandoned, which is a continuation of application Ser. No. 07/658,135, filed Feb. 20, 1991, and now abandoned. This is also a continuation-in-part of copending application Ser. No. 07/977,800, filed Nov. 17, 1992, by Earl W. McCleerey, George R. Defibaugh, Edward K. Marsh, Richard A. Nelson and Gary J. Verdun, which is a continuation of application Ser. No. 07/947,079, filed Sep. 17, 1992, by Earl W. McCleerey and George R. Defibaugh, and now abandoned, which is a continuation of application Ser. No. 07/771,871, filed Oct. 1, 1991, and now abandoned, which is a continuation of application Ser. No. 07/589,143, filed Sep. 27, 1990, and now abandoned.

BACKGROUND OF THE INVENTION

1. Field of the Invention

The subject invention relates to a docking connector for interconnecting the data signals of a lap top computer to a desk top computer.

2. Description of the Prior Art

Portable or lap top computers have become quite popular in recent years, for travellers requiring access to a computer while out of the office. One of the disadvantages of the lap top computers is that, due to their compact nature, the computers cannot contain the electronics of a desk top computer, and therefore cannot perform the same capabilities as a desk top computer.

It is typical then that a user of a lap top computer, when returning to the office, downloads the data accumulated during a trip, from the lap top computer to his or her desk top computer. To this end, most lap top computers have several individual connectors, and the lap top computer is interconnected to the desk top computers via data cables between them. Once the data is downloaded into the desk top computer, the data can be stored within a data base, utilized within a network, for example, as electronic mail, or can be sent to peripheral equipment, such as to a printer.

Presently, due to the number of I/O connections, the interconnected pins number between 200–300, and several connectors are required, such as RS-232 and circular DIN type. While it is desirable to incorporate all connections into one integral multi-row connector, one of the drawbacks to this solution is the possible electrostatic charge which may be discharged by the user to the connector during connection and disconnection, thereby shorting out some or all of the contacts, which may damage circuitry within the lap top and/or the desk top computer.

An object of the invention then is to provide an electrical connector having plural rows of electrical connections, and where the electrical connector is protected from electrostatic discharge.

Other objects and advantages of the invention will be apparent from the following description, the accompanying drawings and the appended claims.

SUMMARY OF THE INVENTION

The object of the invention was accomplished by designing an electrical connector comprising an insulating housing comprising a front mating face and a conductor connecting face, and platform means thereby defining at least two discrete horizontal planar terminal support platforms. Terminal means are supported by the platform means and have a forward mating contact section adjacent the front mating face, and a conductor connecting section adjacent to the conductor connecting face. Shielding means is attached to the insulating housing and forms an annular shielding shroud adjacent to the front mating face. Grounding means are commoned to the shielding means and extend intermediate the two discrete horizontal arrays of planar terminal support platforms.

By providing grounding means intermediate the terminal support platforms, an electrostatic discharge will be commoned to ground through the shielding means.

In a preferred embodiment of the invention, the electrical connector comprises a plurality of rows of electrical terminals, with such grounding means positioned intermediate each said row.

BRIEF DESCRIPTION OF THE DRAWINGS

FIG. 3 is a top plan view of the electrical connector housing;

FIG. 5 is a rear isometric view of the connector partially broken away to show the internal structure of the insulative housing;

FIG. 8 is an end view of the lead frame of FIG. 7;

FIG. 9 is a top plan view of the terminal lead frame shown in FIG. 7;

FIG. 13 is a cross-sectional view of the assembled connector;

FIG. 14 is a front isometric view of a vertical plug connector of the subject invention;

FIG. 16A is an enlarged view of the terminal passageways viewed in FIG. 16;

FIGS. 19A–19C are side plan views of the terminals used in the vertical plug connector shown in FIG. 14;

FIG. 20 is a front plan view of the shield member used with the vertical plug member of FIG. 14;

FIG. 23 shows a cross-sectional view of the plug member;

FIG. 29 is a side plan view of the housing of FIG. 23;

FIG. 30 is a cross-sectional view through lines 30—30 of FIG. 27;

FIG. 31 is a side view of the terminal for use with the vertical receptacle housing of FIG. 23;

FIG. 32 is a front plan view of the shield for use with the vertical receptacle connector assembly; and FIG. 33 is an upper plan view of the tine plate for use with the vertical receptacle assembly.

DETAILED DESCRIPTION OF THE PREFERRED EMBODIMENT

Figure 1:
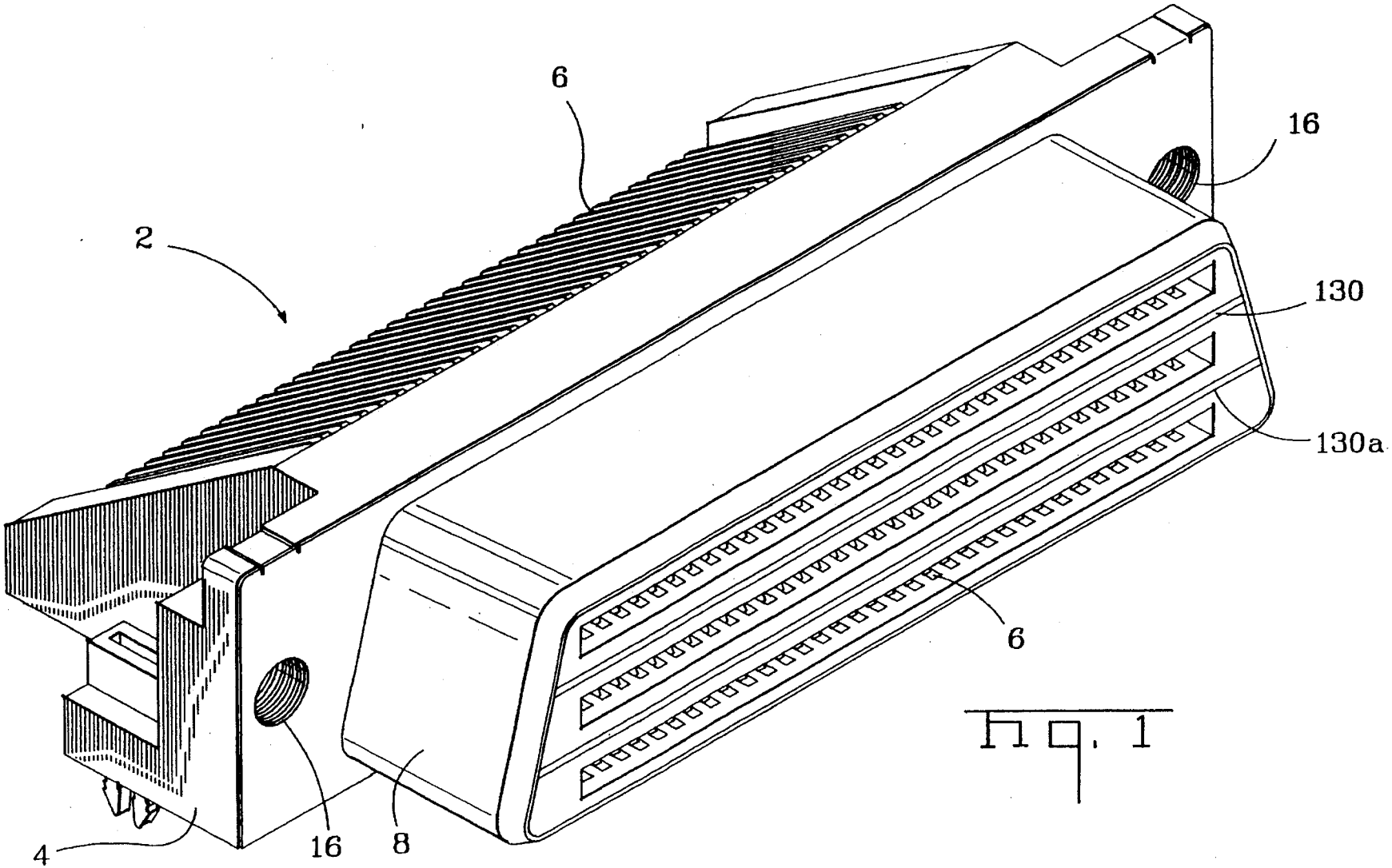
FIG. 1 is an isometric view of the shielded connector of the subject invention.

With reference first to FIG. 1, a shielded electrical receptacle connector is shown, generally at 2, comprising an insulating housing 4 having located therein a plurality of electrical terminals 6 and a front shield member, such as 8.

With reference now to FIGS. 2 through 6, the housing will be described in greater detail. The housing 4 generally includes an intermediate base section 10 having a front face 12 and a mounting surface 14. The base section 10 includes at each side thereof threaded mounting holes such as 16 for securing thereto a mating complementary connector, as will be described in greater detail herein.

Figures 2, 4, 7:
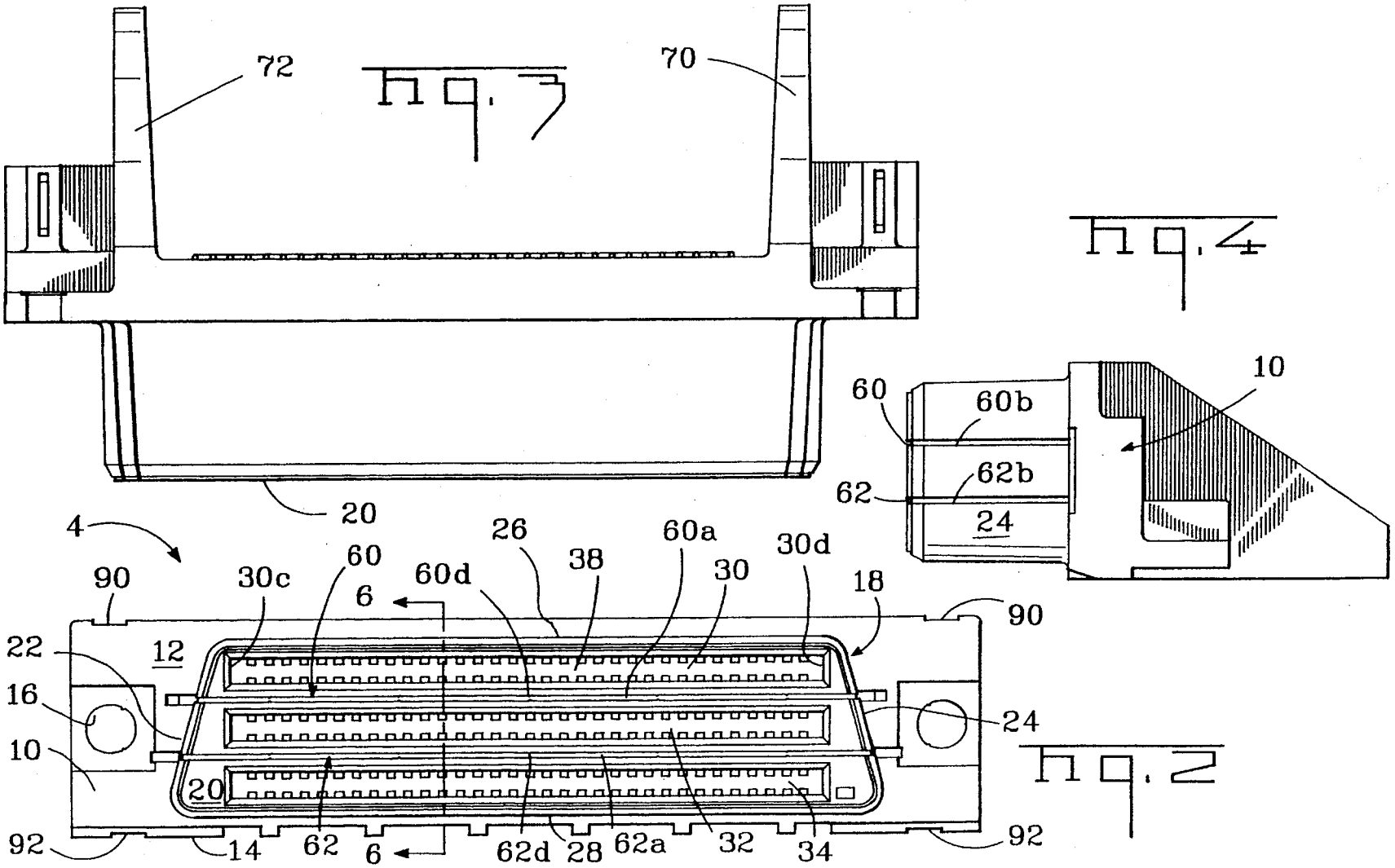
FIG. 2 is a front plan view of the electrical connector housing.
FIG. 4 is a side plan view of the electrical, connector housing.
FIG. 7 is a side plan view of the terminal lead frame used in the receptacle connector of the subject invention.
Figure 7:
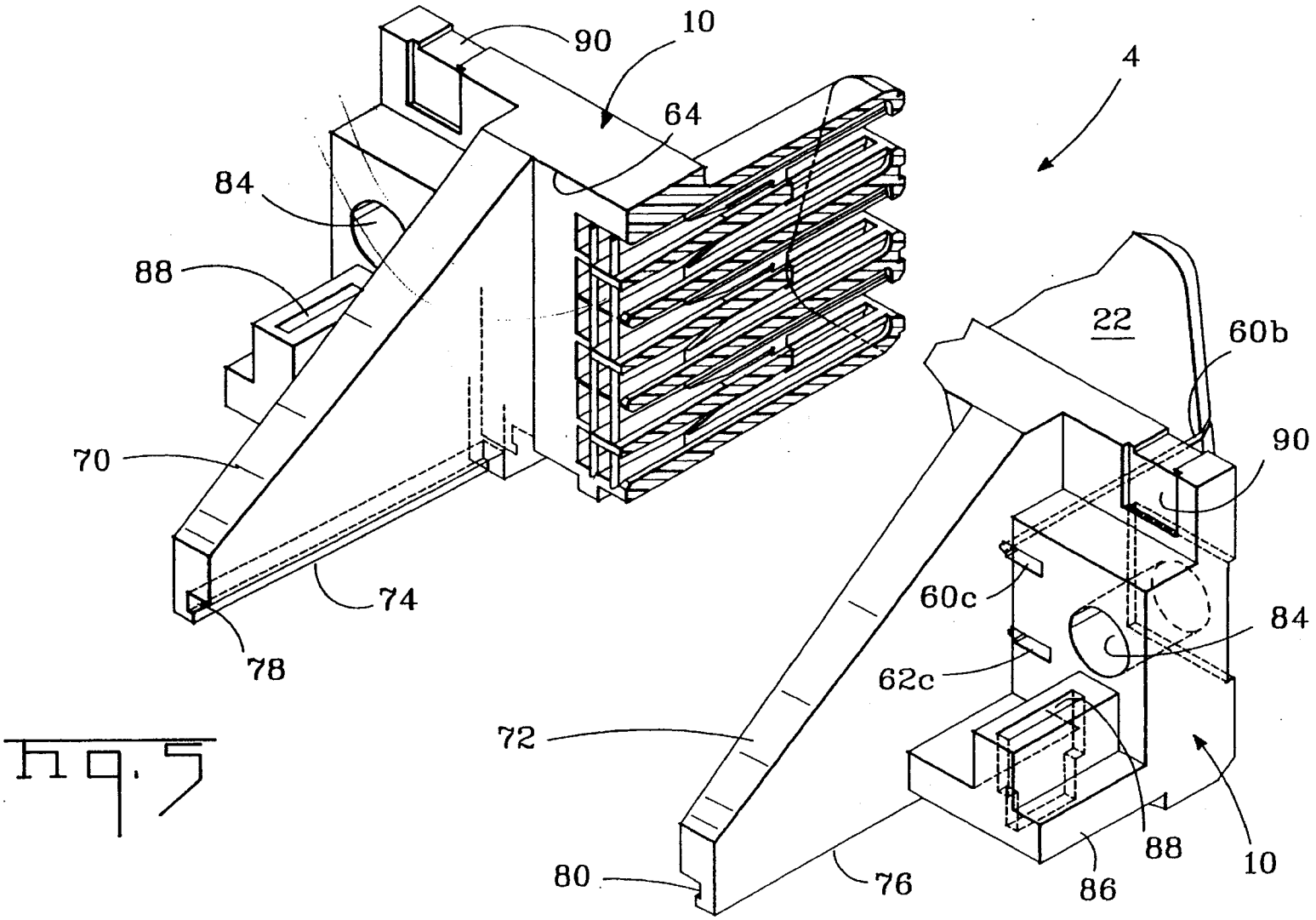

The housing 4 further comprises a front nose portion 18 having a front face 20, side walls 22 and 24, and upper and lower walls 26 and 28, respectively. As shown in FIG. 2, the receptacle includes 3 elongate ports or slots, an upper port 30, an intermediate port 32, and a lower port 34.

Figure 6:
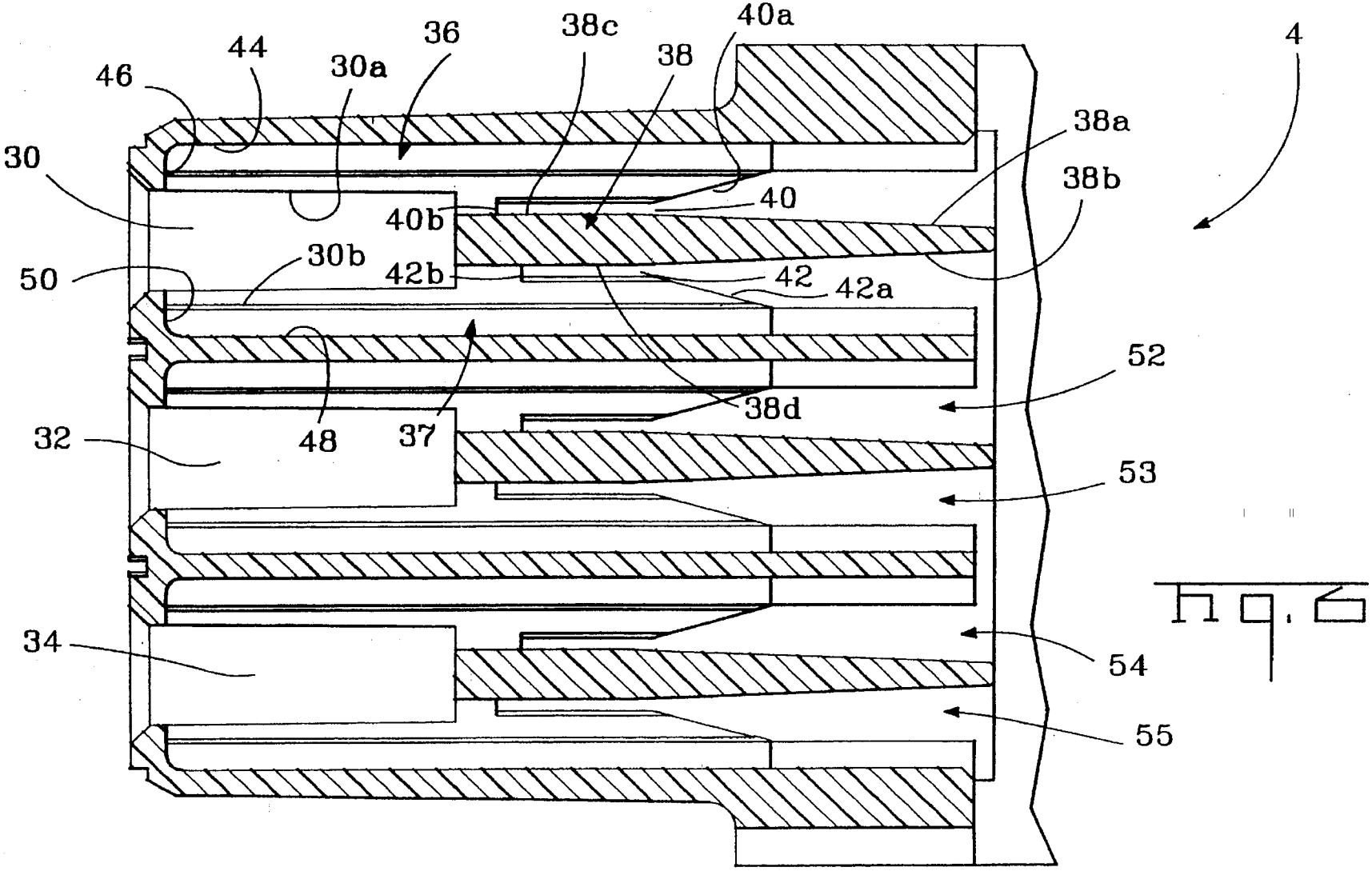
FIG. 6 is a cross-sectional view through lines 6—6 of FIG. 2.
Figure 6:
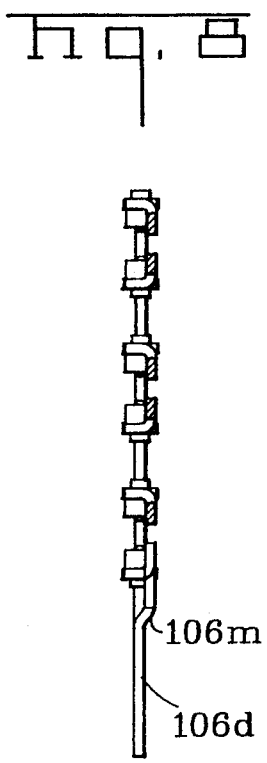
Figure 7:
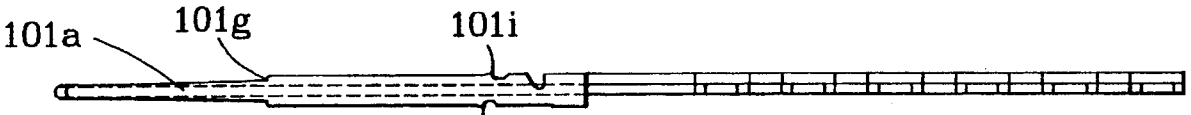
Figure 7:
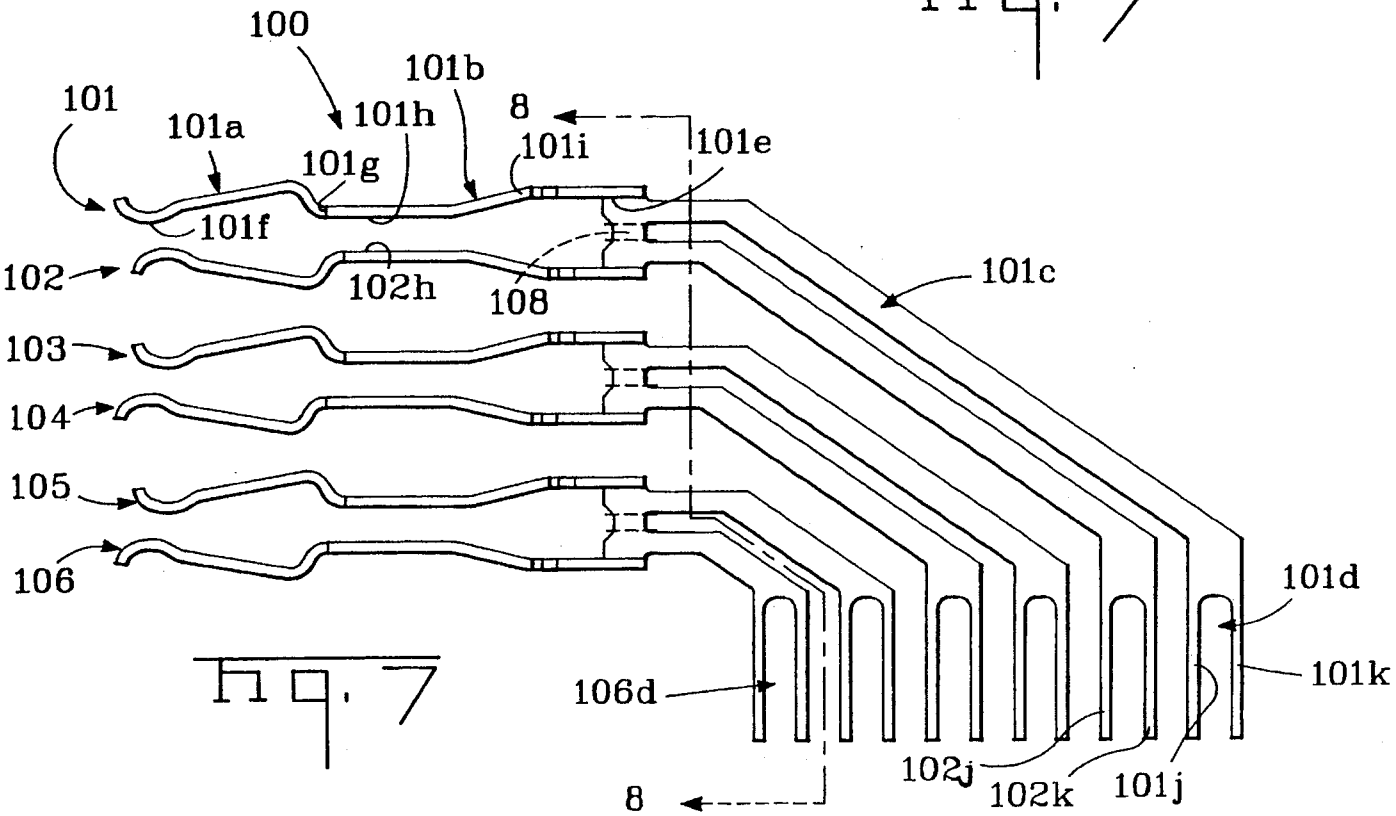

With reference now to FIG. 6, the housing 4 is shown in side section with the slots 30, 32, 34 shown in greater detail. The slot 30 includes an upper surface 30*a* and a lower parallel surface 30*b* and side surfaces 30*c* and 30*d* (FIG. 2). The slot 30 is in communication with a plurality of upper and lower terminal receiving passageways 36 and 37 defined between an intermediate wall portion 38, as shown in FIGS. 2 and 6. The wall portion 38 includes tapered lead in surfaces 38*a* and 38*b* which continue forward and are continuous with generally horizontal surfaces 38*c* and 38*d*, respectively. The terminal receiving passageway 36 further comprises a slot 40 having a lead in surface 40*a* and a forward shoulder 40*b*. The terminal receiving passageway 37 includes a complementary slot 42 having a similar lead in surface 42*a* and a stop shoulder 42*b*. The slot 36 further comprises an upper ceiling portion 44 and a rearward facing shoulder 46. The lower terminal receiving passageway 37 comprises a lower floor portion 48 and a rearwardly facing shoulder 50. As shown in FIG. 6, the slots 32 and 34 are similarly configured. as the slot 30 and therefore will not be described in detail. Suffice it to say that the housing 4 includes terminal receiving passageways 52 and 53 in communication with the slot 32 and terminal receiving passageways 54 and 55 in communication with the slot 34.

With reference again to FIG. 2, an elongate groove 60 is disposed between the slots 30 and 32, whereas an elongate groove 62 is positioned between the slots 32 and 34. Each of the grooves includes opposed indentations, as shown at 60*a* and 62*a*, which will be described in greater detail herein.

With reference now to FIG. 4, the grooves 60 and 62 are continuous along the side wall 24 of the shroud having groove sections 60*b* and 62*b*. The groove portions 60*b* and 62*b* also extend through the central wall portion 10 and, as shown in FIG. 5, terminate in slots 60*c* and 62*c*. It should be noted that in FIG. 4 the shroud side wall 24 is in view whereas in FIG. 5, the shroud side wall 22 is in View, although each side wall includes continuous groove sections 60*b* and 62*b* continuous with the side walls 22 and 24 of the shroud 18.

With reference still to FIG. 5, the housing 4 further comprises two mounting legs, such as 70 and 72, where the legs extend away from a rear surface 64 of the central wall portion 10, and include mounting surfaces, such as 74 and 76. Each of the mounting legs 70 and 72 includes horizontal slots, such as 78 and 80, the purpose for which will be described in greater detail herein. In the preferred embodiment of the invention, the central wall portion 10 includes mounting through holes, such as 84, where the through holes 84 include press-fit or molded-in threaded inserts to assist in the mating engagement with a complementary connector. The housing 4 further includes two mounting feet, such as 86, on either side of the mounting legs 70 and 72, having a slot, such as 88, wherein in the preferred embodiment of the invention, the slots 88 include printed circuit board retention features, such as the split arrow device which is well-known in the art. Finally, the central wall portion 10 of the connector housing 4 includes two recesses, such as 90, along the top section thereof, as shown in FIG. 5, and includes two recesses 92, along the lower side thereof, as shown in FIG. 2, as will be described in greater detail herein.

As shown in FIG. 7, the terminals are stamped and formed in the form of a lead frame 100 comprising individual terminals 101 through 106. Each of the terminals comprises similar individual components, so only the first terminal 101 will be described in great detail. With respect to FIG. 7, the terminal 101 generally comprises a contact section 101*a*, a cantilevered beam section 101*b*, an intermediate lead section 101*c* and a printed circuit board contact section 101*d*. It should be noted from the configuration of the lead frame 100 that the individual terminals are stamped in the plane of the intermediate contact section 101*c* and the cantilever beam section 101*b* is then folded about an upper edge 101*e* of the intermediate section 101*c*, with the folded over portion formed into the configuration shown in FIG. 7. In this configuration, the terminal 101 includes a forward contact surface 101*f*, a shoulder 101*g*, a horizontal surface 101*h*, and locking barbs 101*i*. It should be noted that each of the printed circuit board contact sections, such as 101*d*, includes alternative tines 101*j* and 101*k*, where one of the tines can be selected to stagger the pattern of the tines to increase the density of interconnection on a printed circuit board. It should also be noted that two terminals are integrally connected through a web section 108 between the two terminals to maintain the requisite spacing during assembly purposes, as will be described in greater detail herein. It should be noted from FIG. 8 that the printed circuit board contacts sections, such as 106*d*, are staggered over at 106*m* to place the centerline of the printed circuit board contact sections 106*d* collinear with the centerline of the terminals 101–106.

Figures 10, 11:
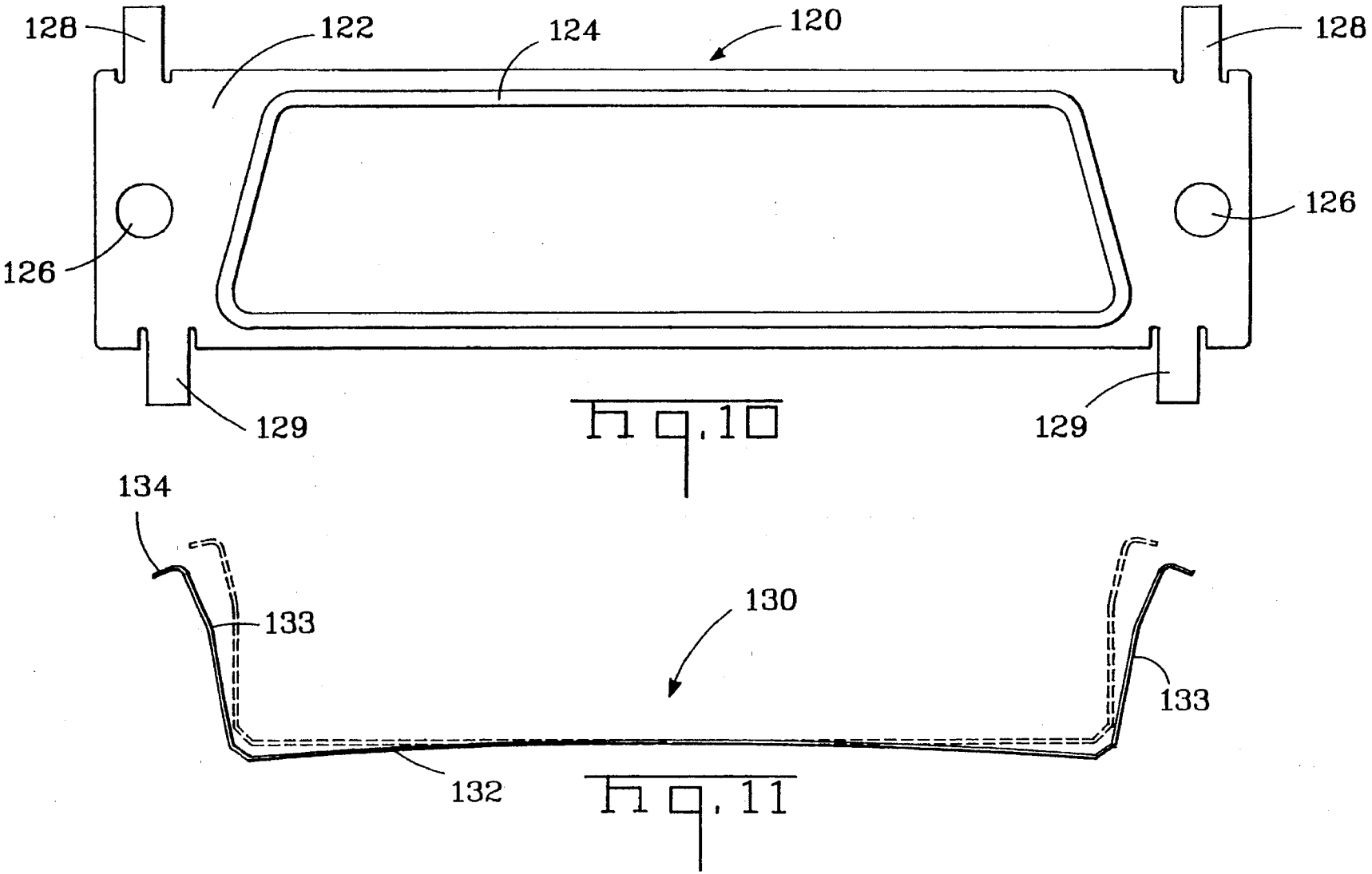
FIG. 10 is a front plan view of the shield member of the subject invention.
FIG. 11 is an upper view of the drain wire of the subject invention.

With reference now to FIG. 10, the front shield member is shown generally at 120 comprising a generally flat plate section 122 having an integral drawn shielding shroud 124 extending forwardly from the plate section 122. The plate section 122 includes through holes 126 profiled to align with the apertures 84 in the housing 4 (FIG. 5) and further comprises integral tab sections 128 profiled to meet the recesses 90 in the housing 4, and tabs 129 which are profiled to meet the recesses 92 in the housing 4.

With reference now to FIG. 11, a drain wire is shown generally at 130 and comprises a front wire section 132, side sections 133, and hook sections 134. It should be noted that the drain wire 130 is formed with the front wire portion 132 in a bent configuration so as to preload the drain wire. Although described in greater detail herein, the drain wire is generally profiled to match the groove 60 in the housing shroud 18 (FIG. 2), with the opposed indentations 60*a* pinching the wire in place. It should also be noted that a further drain wire 130*a* (FIG. 1) is also included which is identical to the drain wire 130, although profiled to fit in the groove 62 which is somewhat longer than the groove 60 due to the D-shaped configuration of the front face.

Figure 12B:
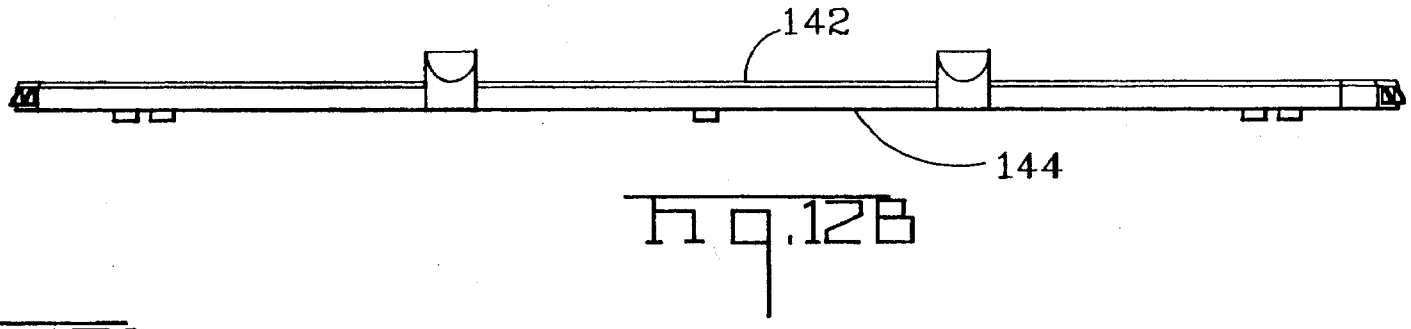
FIG. 12B is a front plan view of the tine plate of the subject invention.
Figure 12A:
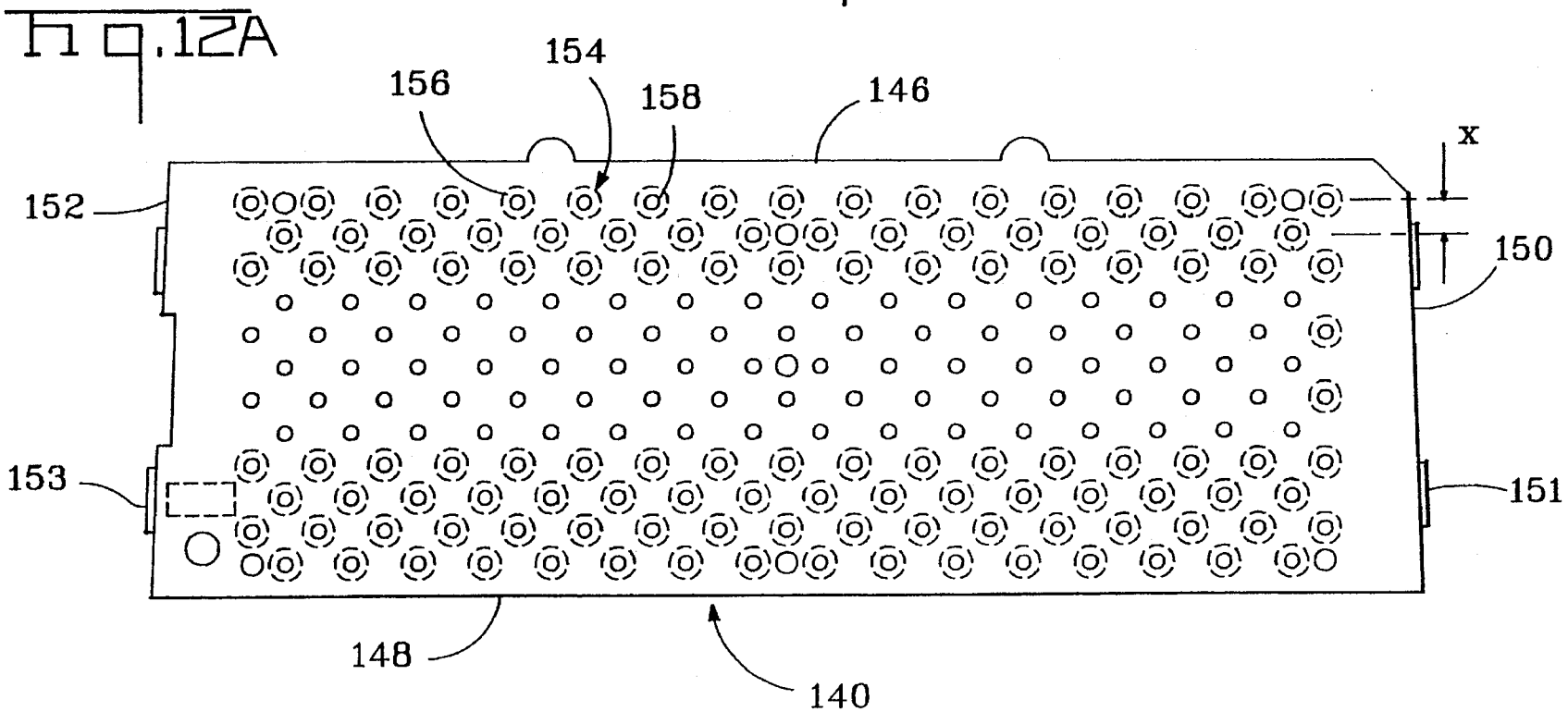
FIG. 12A is a top plan view of the tine plate of the subject invention.
Figure 12:
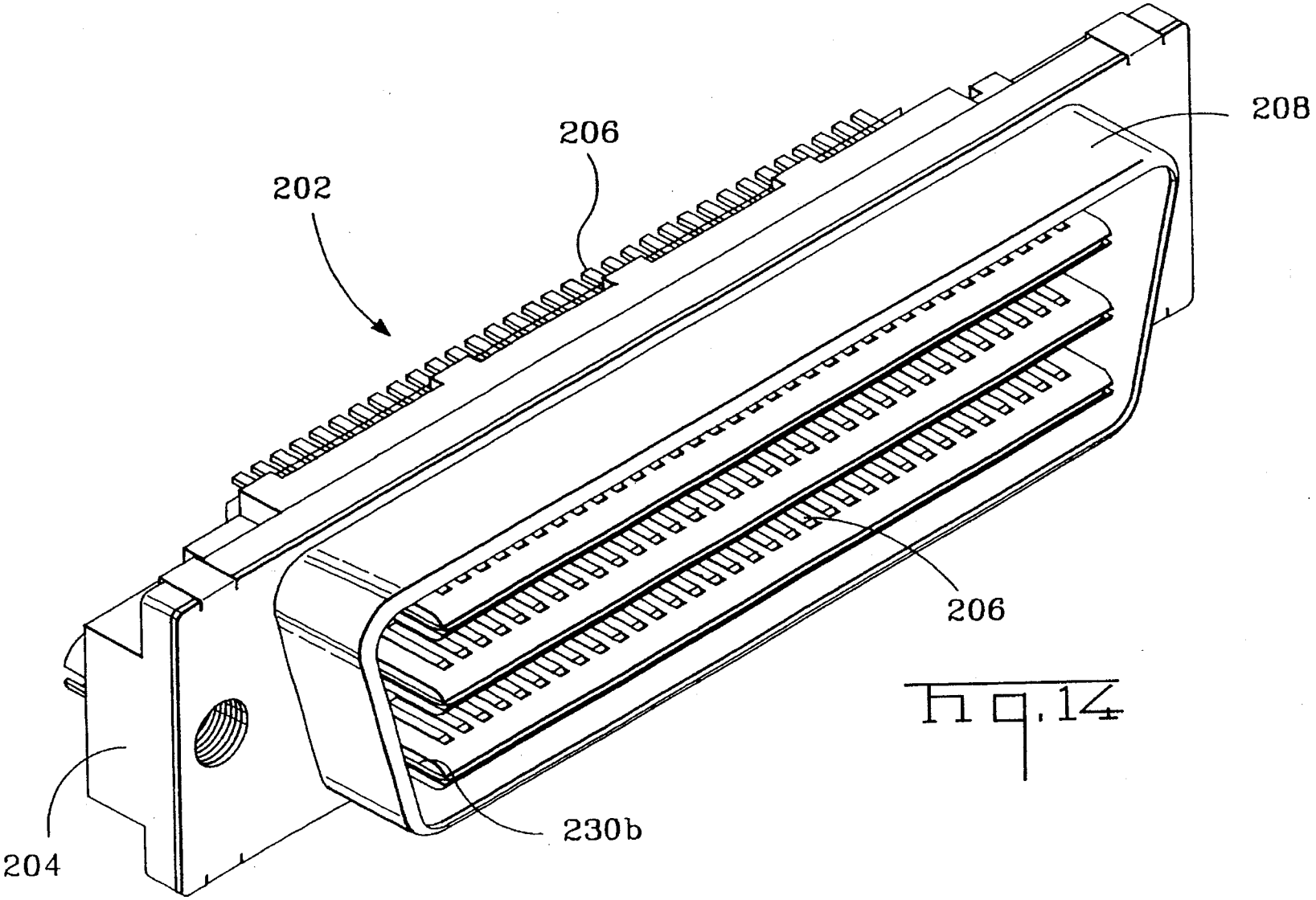

With reference now to FIGS. 12*a* and 12*b*, a tine plate 140 is shown as including an upper surface 142 and a lower surface 144. The tine plate 140 also includes a forward edge 146, a rear edge 148, and side edges 150 and 152. It should also be noted that the tine plate includes twelve rows of apertures, such as 154, where each of the apertures includes a conical lead in section 156 and a narrowed aperture 158. The adjacent rows of apertures 154 have centerline spacings, such as "x" shown in FIG. 12, equal to the spacing between the alternate printed circuit board tab portions 101*j* and 101*k*, as described with respect to FIG. 7. It should also be understood that the distance between consecutive tab sections in adjacent terminals is also equal to x, for example, the distance between 101*j* and 102*k*; and 102*j* and 103*k*.

With reference now to FIG. 13, the terminals 101–106 are shown inserted within the respective terminal receiving passageways, the terminals being inserted such that the lower surfaces, such as 101*h* and 102*h* (FIG. 7), are in an abutting manner with respective surfaces, such as 38*c* and 38*d* (FIG. 6). As shown in FIG. 6, the terminals are positioned within the terminal receiving passageways, such that the front shoulder, such as 101*g*, is slid into the respective slot 40, to a position where the shoulder 101*g* abuts the forward surface 40*b*. It should be noted that the shoulders, such as 40*b* and 42*b*, are axially staggered which, as shown in FIG. 13, axially staggers the contact surfaces, such as 101*f* and 102*f*. It should be understood that when the terminal lead frame 100 is inserted from the rear side of the connector housing 4, one of the printed circuit board tine sections, such as 101*j* or 101*k*, is selected, depending on the lateral position of the lead frame to stagger the printed circuit board tine sections into the configuration of the tine plate 140 as shown in FIG. 12A. It should also be understood that for each lead frame the same printed circuit board tine is selected, while the other tine is stamped free of the terminal, for example, as shown in FIG. 13. With the terminals 101 through 106 inserted within their respective terminal receiving passageways, the tine plate 140 can be aligned with the individual tines and then moved upwardly to a position where the latches 151 and 153 snap in place within the slots 78 and 80 (FIG. 5), thereby maintaining the individual tines in their requisite array.

The drain wires 130 can now be inserted within their corresponding grooves 60 and 62 such that the hook sections 134 are positioned within the slots, such as 60*c* and 62*c*, and the side sections 133 are positioned within the grooves 60*b* and 60*c*, and the frontal portion 132 resides within the front groove sections 60*a* and 62*a*. The indentations 60*d* and 62*d* assist in retaining the drain wire portion 132 within the respective groove sections. The shield 120 can now be inserted over the housing such that the drawn shroud section 124 is placed over the shroud portion 118 of the housing 4 and the plate section 122 abuts the forward surface 12 (FIG. 2) of the housing 4, and consequently traps the drain wire in place. The tabs 128 and 129 can then be bent about the central wall section 10 to reside in the respective recesses 90 and 92 thereby retaining the shield member 120 to the housing member 4, and ensuring that the shield 120 and drain wires 130 are commoned together.

Figure 17:
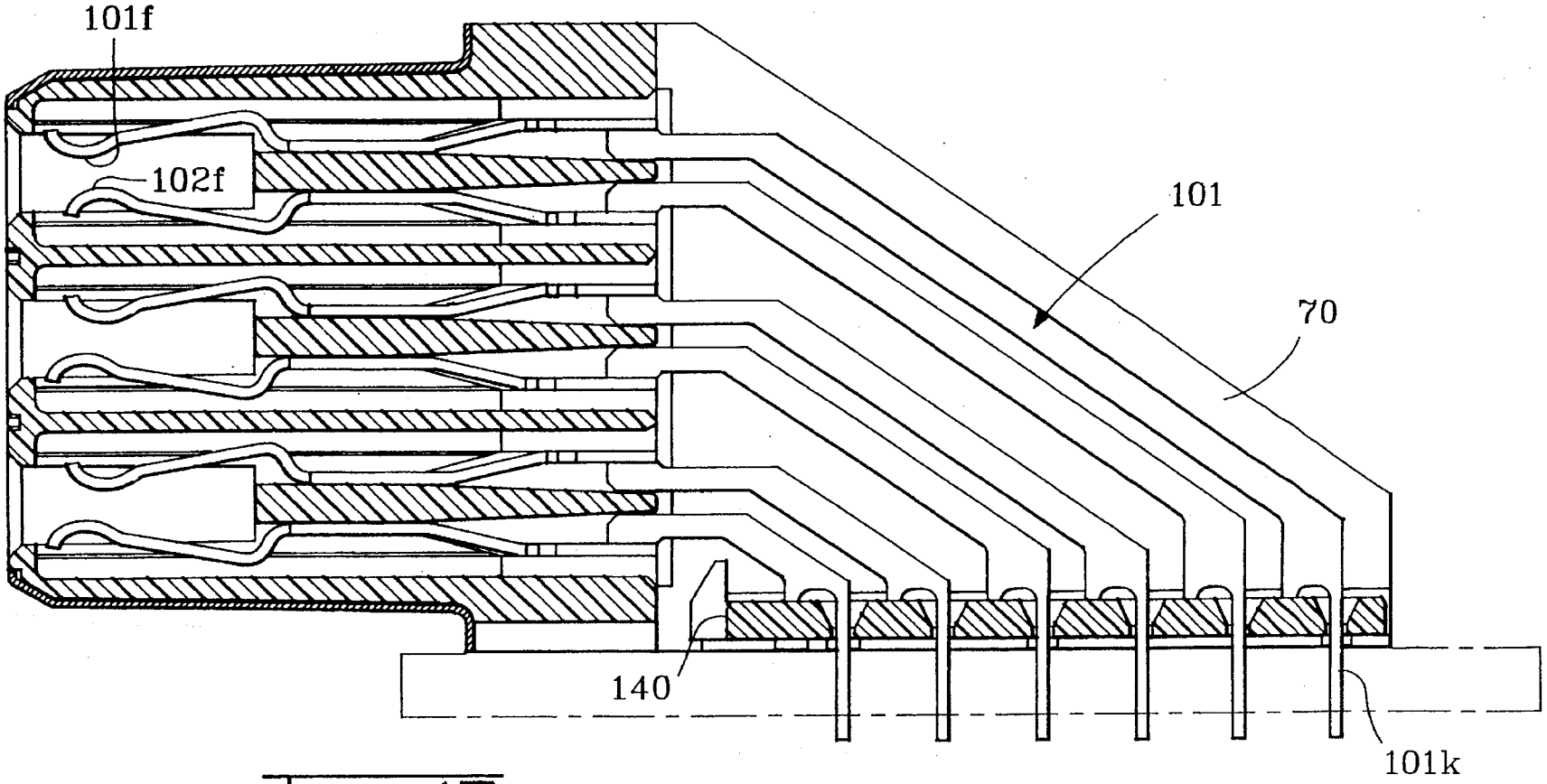
FIG. 17, is a cross-sectional view through lines 17—17 of FIG. 15.
Figure 16:
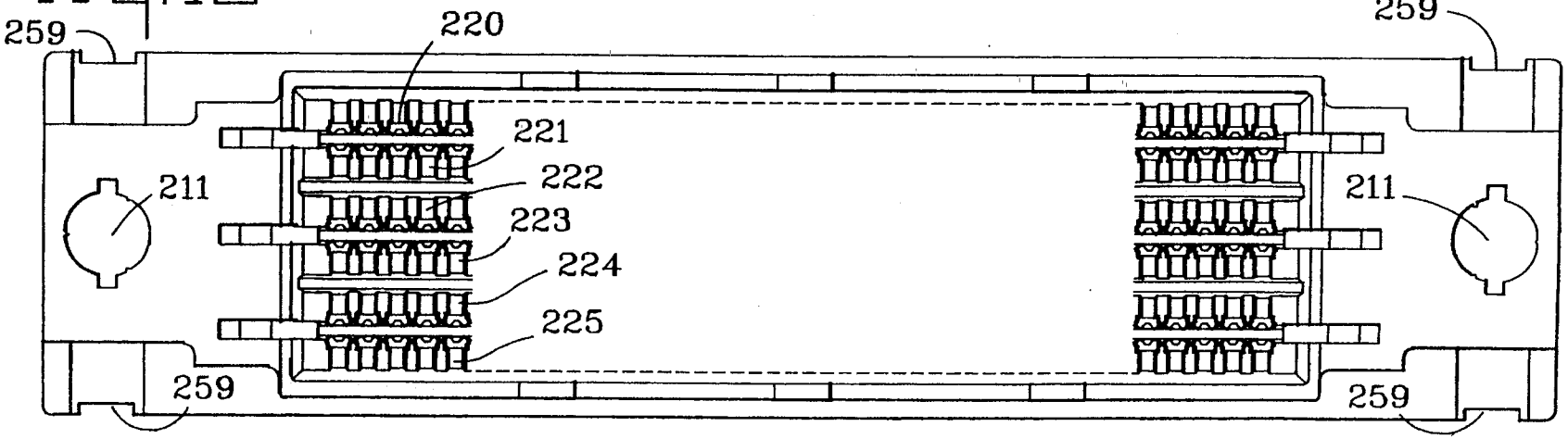
FIG. 16 is a rear plan view of the housing of FIGS. 14 and 15.
Figures 16, 17, 18:
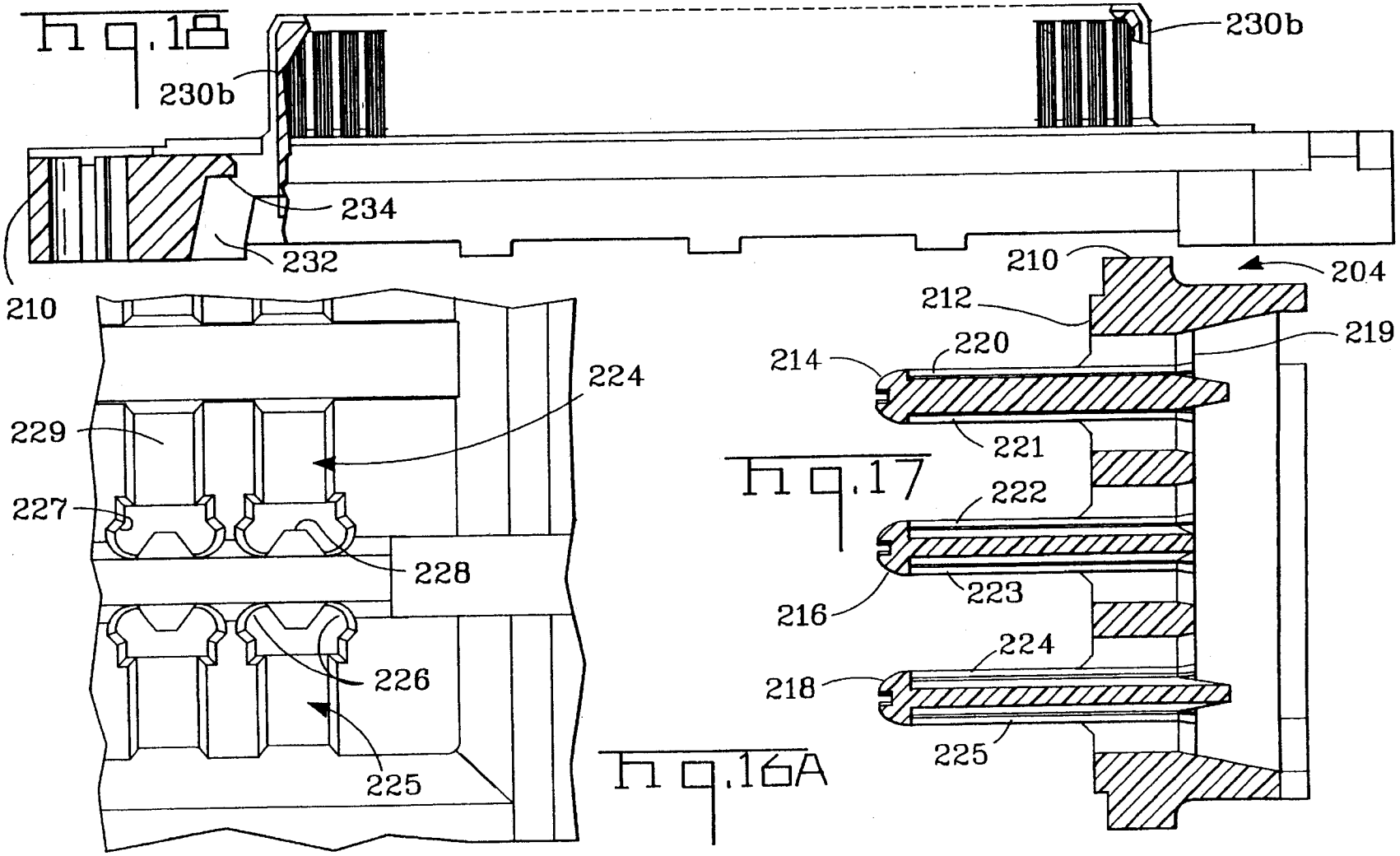
FIG. 18 is a top plan view of the housing of FIG. 16.
Figure 21:
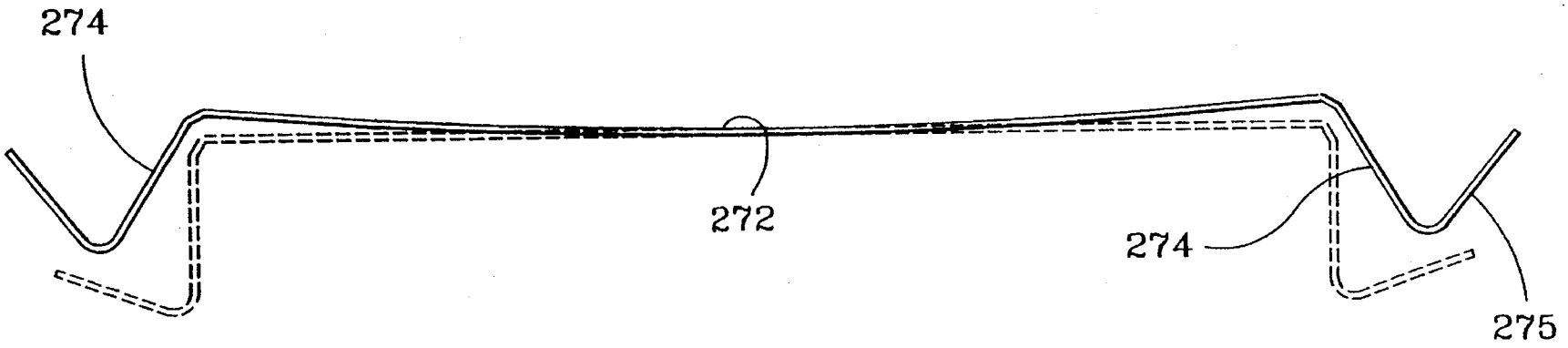
FIG. 21 is a drain wire used with the vertical plug connector of FIG. 14.

With reference now to FIG. 14, a mating plug connector 202 is shown generally comprising a housing 204 having a plurality of electrical terminals 206, and comprising an outer shielding shell 208. As shown in FIG. 18, the housing 204 comprises a central wall section 210, shaped with an interior as shown at 232 and 234, having a front mating face 212 thereof, with terminal receiving platforms 214, 216, and 218 extending forwardly and integrally from the front face 212 of the central wall portion 210. The housing 204 further comprises a rear wall portion 219 having terminal receiving passageways 220 to 225 extending forwardly therefrom. As shown in FIG. 16*a*, the terminal receiving passageways 220 through 225 are generally shaped as keyhole slots having flared channels shown generally at 226, (thereby forming shoulders 227, and platform 228), and a rectangular slot portion shown generally as 229. As shown in FIG. 17, the slots 220–225 do not extend through the front of the platforms 214–218, but rather end proximate to the forward end of each of the platforms.

Figure 15:
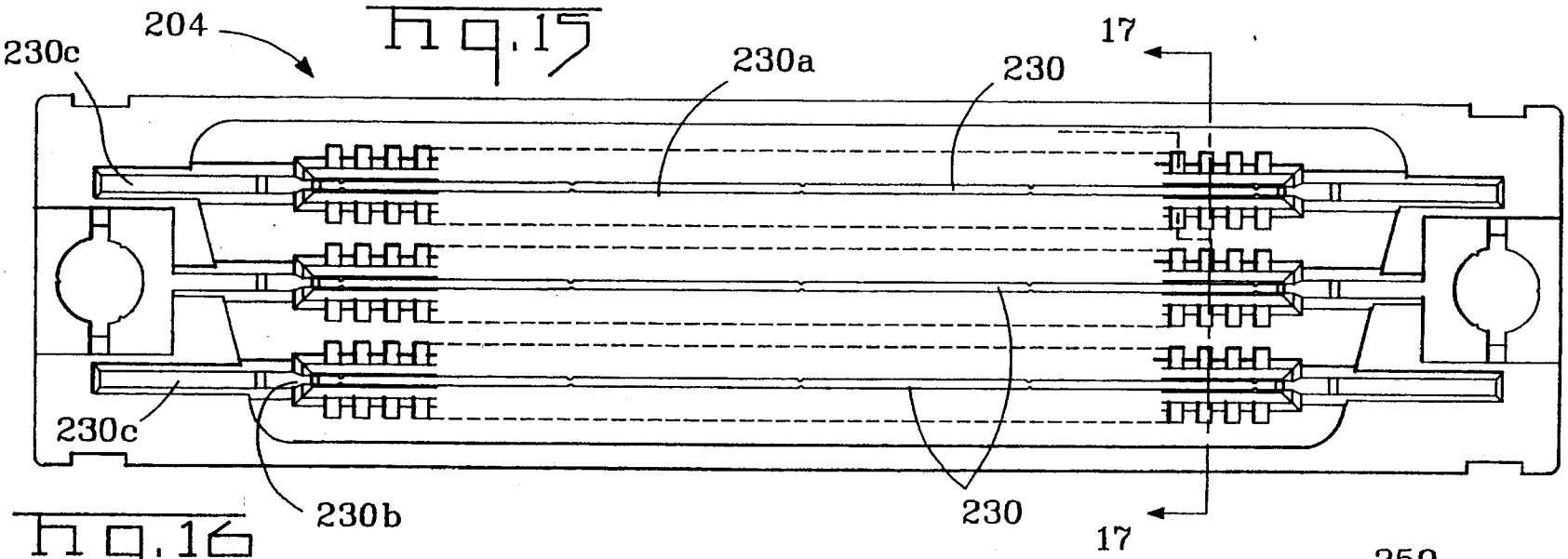
FIG. 15 is a front plan view of the housing of the plug connector shown in FIG. 14.

With reference now to FIG. 15, each of the platforms 214–218 includes a groove 230 therein including a front portion 230*a* and side portions 230*b*, as shown in FIGS. 14 and 18. The side groove 230*b* extends rearwardly along the platforms 214, 216, 218, and then extends outwardly along the face, as at 230*c*.

With reference now to FIG. 19A through 19C, the connector comprises a plurality of terminals 250, 252, and 254. As shown in FIG. 19A, the terminal 250 comprises a forward contact section 250*a* and a rearward printed circuit board contact portion 250*b*. The terminal 250 further includes locking barbs 250*c*, and retention arms or wings 250*d* extending from each side of the contact portion and extending downwardly, and profiled for a receipt within the sections 226 (FIG. 16A). As shown in FIG. 19B and 19C, the terminals 252, 254 comprise contact surfaces 252*a*, 254*a*, printed circuit board contacts 252*b*, 254*b*, barbs 252*c*, 254*c* and locking arms 252*d*, 254*d*.

With reference now to FIG. 23, the terminal portions 254 are first inserted into the center terminal receiving passageways 222 and 223 (FIG. 16), with the locking arm portions 254 appropriately positioned in the sections 226 (FIG. 16) of the terminal passageways. As shown in FIGS. 16 and 17, the sections 226 extend the entire length of the passageways 220–225, thereby aligning and retaining the respective terminals within the respective passageways. The terminals, while cantilevered out on the respective platforms 214, 216, 218, are prevented from movement by way of the locking wings 250*d*, 252*d* and 254*d* against the shoulders 227 within the respective terminal receiving passageway. This positions the printed circuit board contact portions 254*b* extending beyond the rear face of the plug housing 204. The terminals 252 are next inserted in the passageways 221 and 224, once again with the locking arm sections 252*d* appropriately positioned in the sections 226 (FIG. 16) of the terminal passageways 221 and 224. This places the printed circuit board contact 252*b* in a staggered position towards the printed circuit board portions 254*b*, as shown in FIG. 23. The terminals 250 are then inserted in the rows of terminal passageways 220 and 225 with the retaining arms 250*d* in the respective sections 226, such that the printed circuit board contact portions 250*b* are staggered towards the printed circuit board contact portions 252*b*, as shown in FIG. 23.

Figure 26:
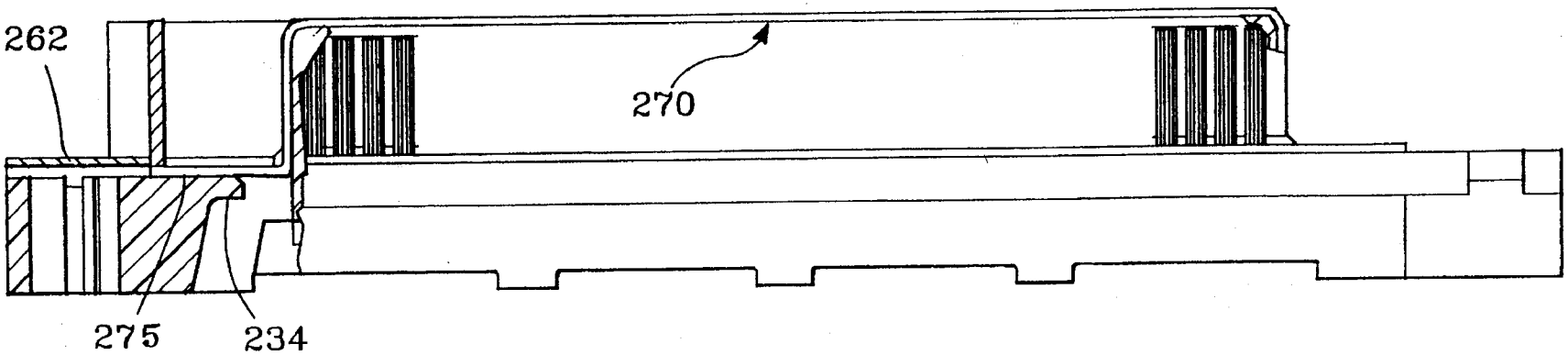
FIG. 26 is a top plan view of an insulating housing for use with the vertical receptacle assembly of FIG. 25.

With reference now to FIG. 26, the drain wires 270 are inserted into their respective grooves 230 with the drain wire portions 272 positioned along the groove sections 230*a* and the drain wire side portions 274 positioned along the groove portions 230*b* (FIG. 14). Continued insertion of the drain wire positions the wire portions 275 within the respective grooves 230*c*. The shield member 208 is now insertable over the housing 204 with the tabs 266 folded over in locking engagement with the recesses 259 (FIG. 16). As assembled, the portions 275 of the drain wire are in spring-loaded engagement against the backside of the plate portion 262 of the shield member 260 as shown in FIGS. 24 and 26, assuring an adequate grounding between the drain wire and the shield member 260.

Figure 22:
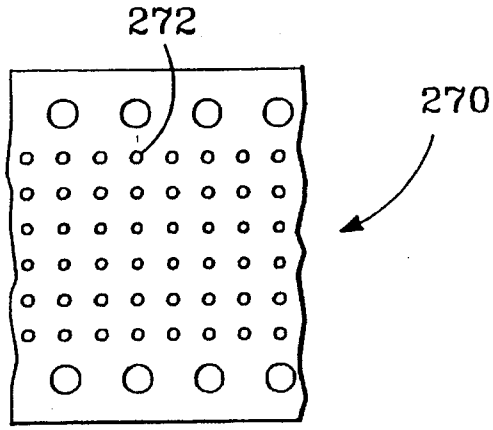
FIG. 22 is a tine plate used with the vertical plug connector of FIG. 14.

To maintain the printed circuit board terminal portions 250*b*, 252*b*, and 254*b*, in the predetermined array as shown in FIG. 22, a mylar sheet, such as 270, as shown in FIG. 22, is positioned over the backside of the housing member 204 and has a plurality of apertures, such as 272, positioned over the printed circuit board portions 250*b*, 252*b*, and 254*b*.

Figure 24:
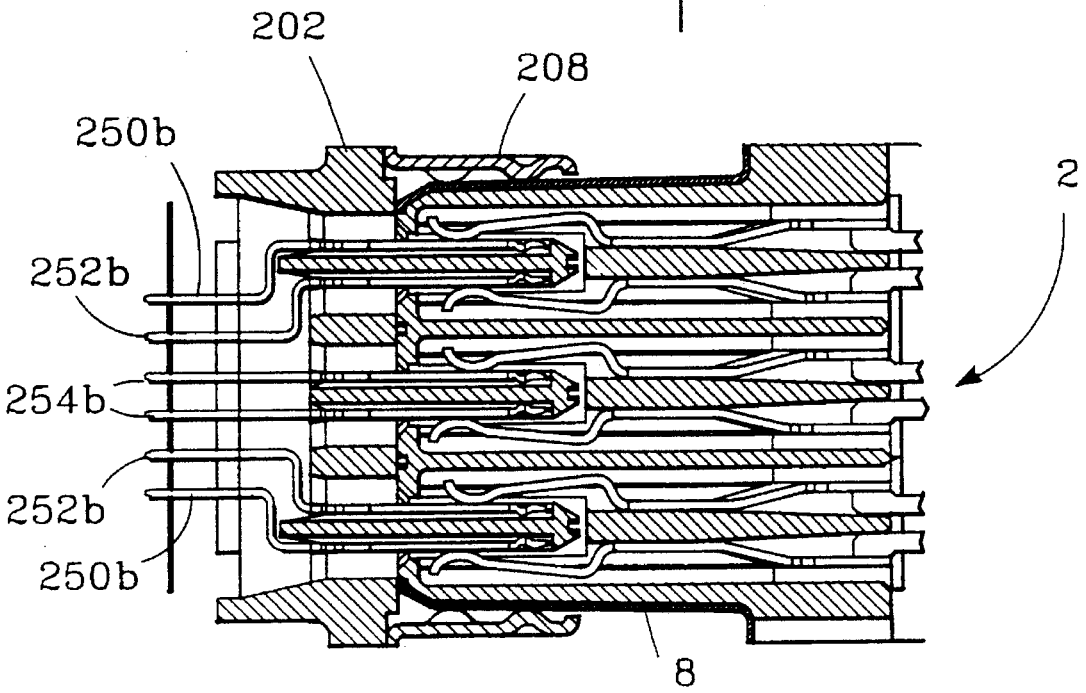
FIG. 24 shows a cross-sectional view of the mated receptacle and plug member.
Figure 25:
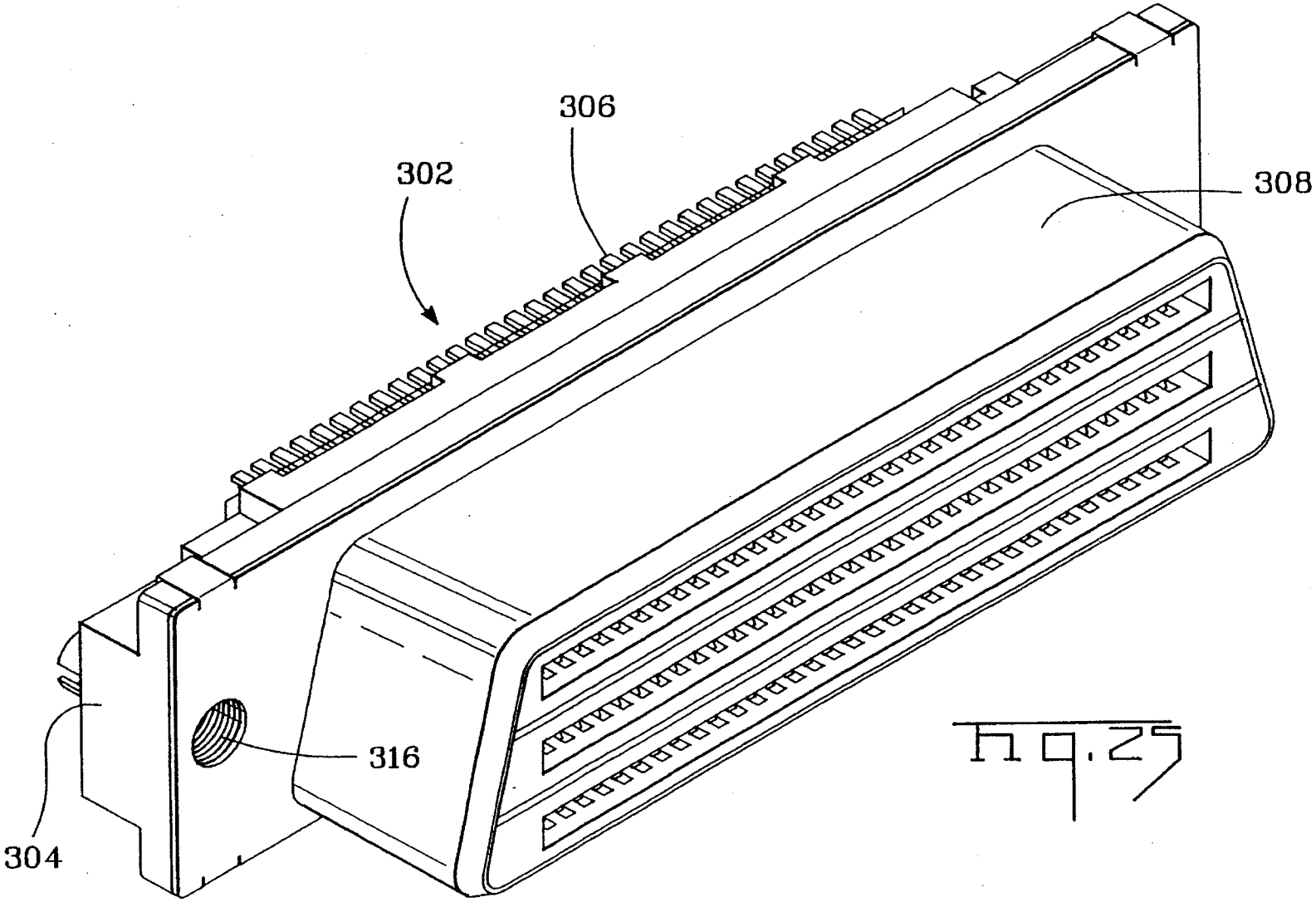
FIG. 25 is an isometric view of an alternate embodiment vertical receptacle.
Figure 27:
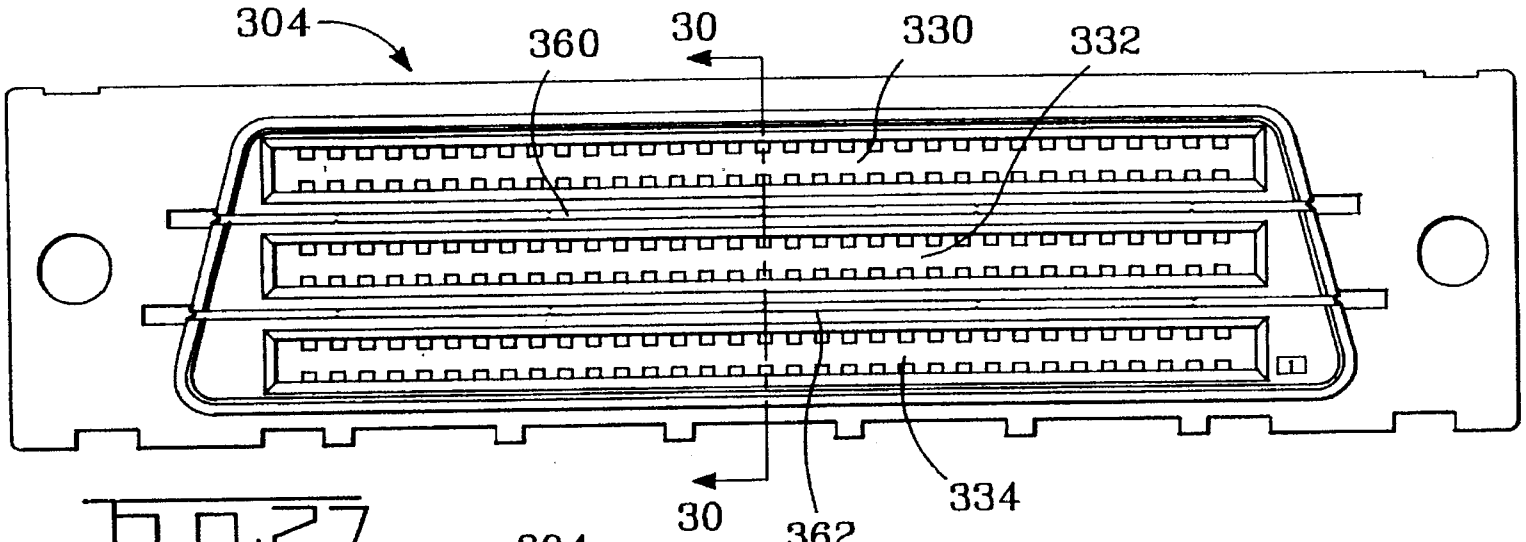

As shown now in FIG. 24, the terminal receiving platforms 214, 216, and 218 are receivable in the slots 30, 32, and 34 of the receptacle housing in order to position the receptacle contacts 101–106 in mating engagement with the plug contacts 250, 252, and 254. As also shown in FIG. 24, as mated, the shield 208 of the plug member is in mating engagement with the outer shield 8 of the receptacle member 2.

With reference now to FIGS. 25 through 33, an alternate embodiment of the receptacle connector is shown generally at 302 comprising an insulative housing 304 carrying a plurality of contacts 306 and having threaded mounting holes 316 and an external shield, such as 308.

Figure 27:
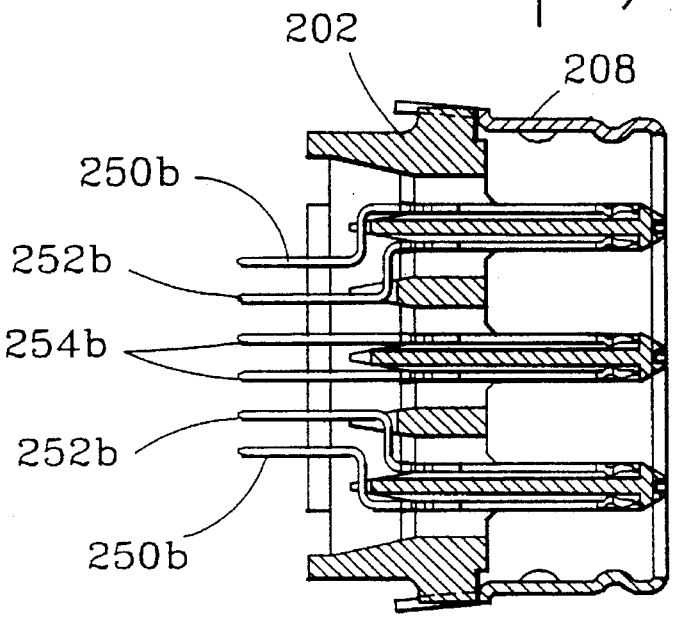
FIG. 27 is a front plan view of the assembled vertical receptacle.
Figure 28:
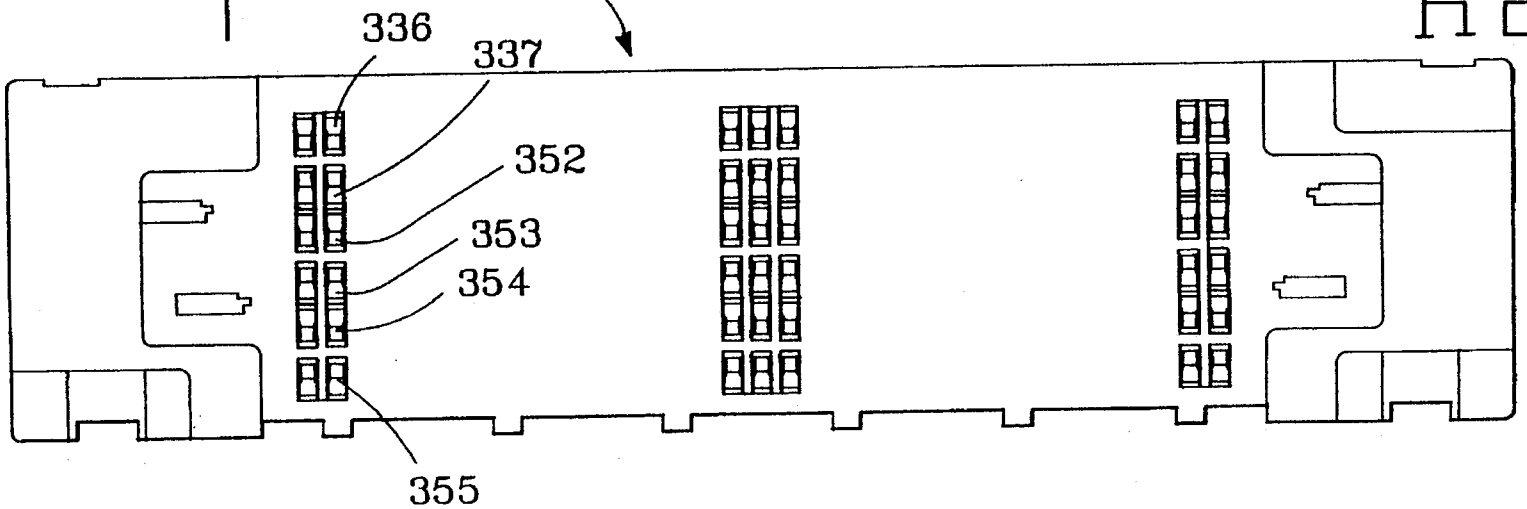
FIG. 28 is a rear plan view of the housing shown in FIGS. 23 and 24.

With reference first to FIG. 27, the housing 304 is similar in nature to the housing shown in FIG. 2, having elongate slots 330, 332, and 334 similarly profiled to receive the terminal support platforms 214, 216, 218 (FIG. 17) of the plug connector 204. Also similarly, as shown in FIG. 27, the vertical receptacle includes grooves 360 and 362 for the receipt of a drain wire which is identical to that shown in FIG. 11. Also similar in nature to the right-angled mount receptacle connector 2, as shown in FIG. 28, the receptacle connector 304 includes terminal receiving passageways 336, 337, 352, 353, 354, and 355, each of which is profiled as shown in FIG. 30.

As shown in FIG. 31, a terminal for use with the vertical receptacle member is shown generally at 400 and comprises a forward contact section 400*a* and a printed circuit board-mount portion 400*b*. A forward positioning shoulder 400*c* abuts the shoulder in the terminal receiving passageways in a similar nature as that shown in FIG. 13 above. Also similar to that shown above, the receptacle housing 304 can receive the drain wire shown in FIG. 11 in the slots 360 and 362 (FIG. 27) and are spring-loaded in place when the shield is positioned against the housing as shown in FIG. 26.

As disclosed, an electrical connector is capable of having a plurality of rows of electrical terminals, and yet be free of electro-static discharge. As a result of the density of the connectors, and particularly the plurality of rows of connectors, the connector terminals were susceptible of attracting electrostatic discharge. As the number of intermediate rows of terminals increases, the distance between the terminals and the shield increases, and furthermore, the intermediate rows have no shield between them at all. The drain wire is therefore positioned intermediate each row of terminals, and prevents the electrostatic discharge onto the terminals. It has been found that steel wire, such as music wire 0.010 inches in diameter, is sufficient for such use electrostatic discharge.

While the form of apparatus herein described constitutes a preferred embodiment of this invention, it is to be understood that the invention is not limited to this precise form of apparatus, and that changes may be made therein without departing from the scope of the invention which is defined in the appended claims.

We claim:

1. A shielded electrical connector, comprising:

an insulating housing comprising a front mating face and a conductor connecting face, and platform means defining at least two discrete horizontal planar terminal support platforms spaced parallel to each other;

terminal means supported by each of said platforms and having a forward mating contact section adjacent the front mating face, and a conductor connecting section adjacent to the conductor connecting face;

shielding means attached to said insulating housing, forming an annular shielding shroud around said platform means, adjacent to the front mating face; and grounding means commoned to said shielding means and extending intermediate two discrete horizontal, parallel arrays of said terminal means on said platforms.

2. The electrical connector of claim 1, wherein said grounding means is discrete from said shielding means.

3. The electrical connector of claim 2, wherein said grounding means is positioned at the front mating face.

4. The electrical connector of claim 1, wherein said terminal support platforms extend forwardly to said front mating face.

5. The electrical connector of claim 4, wherein each side of each of said terminal support platforms supports said terminal means, thereby defining at least four rows of terminals.

6. The electrical connector of claim 5, wherein said terminal support platforms each include at a front end thereof a longitudinal groove therein for receiving said grounding means.

7. The electrical connector of claim 6, wherein said grounding means comprises a discrete wire positioned in each of said grooves, wherein said wires are trapped between said shielding means and said housing.

8. The electrical connector of claim 1, wherein said terminal support platforms extend forwardly from said rear wall, with said platforms supporting at least one terminal of said terminal means on each side thereof.

9. The electrical connector of claim 8, wherein said terminals include resilient contact beams.

10. The electrical connector of claim 8, wherein the terminals are positioned in grooves on each side of said terminal support platforms and extend forwardly towards an end of said platform, and said platforms include grooves at said platform ends and along side edges thereof for receipt of said grounding means.

11. A shielded electrical connector, comprising:

an insulating housing having at least six parallel, discrete terminal receiving surfaces extending between a front mating face and a rear face, each terminal receiving surface comprising terminal receiving slots therein extending from said rear face towards said front face;

a plurality of electrical terminals positioned along respective said terminal receiving slots, thereby forming six parallel rows of terminals, each said row having contact portions adjacent to said front mating face, and conductor connecting portions adjacent to said rear face;

shielding means comprising a shielding shell at least partially surrounding said housing, said shielding means further comprising a grounding strip commoned to said shielding shell and extending between pairs of said terminal receiving surfaces.

12. The electrical connector of claim 11 wherein said front mating face includes a groove for receipt of said grounding strip.

13. The electrical connector of claim 12, wherein said grounding strip comprises a discrete clip interference fit between said shielding shell and said housing.

14. The electrical connector of claim 10, wherein the electrical connector is defined as a plug connector.

15. A grounded and shielded electrical connection, comprising:

a plug connector comprising an insulating housing having a rear mounting portion and at least two terminal supporting walls extending integrally outwardly from said mounting portion, said walls including terminal supporting channels on each side of said wall which support electrical terminals disposed generally against said channels, each said supporting wall including at a front thereof, a groove extending thereacross carrying a discharge strip which is electrically commoned to an outer shielding shell; and a receptacle connector comprising an insulating housing having a rear mounting portion and a front mating face having at least two elongate openings therethrough adapted for receiving said terminal supporting walls of said plug connector, and further comprising receptacle terminals flanking said openings adapted for electrical connection with said plug terminals upon insertion of said terminal supporting walls of said plug connector, said front mating face having a groove thereacross carrying a discharge strip commoned to an outer shielding shell, said receptacle connector being profiled for mating engagement with said plug connector with said respective shielding shells in electrical contact with each other.

16. The connection of claim 15, wherein said discharge strips of said plug and receptacle connectors comprise discrete wires positioned in said grooves in electrical contact with said respective outer shielding shells.

* * * * *

UNITED STATES PATENT AND TRADEMARK OFFICE

CERTIFICATE OF CORRECTION

PATENT NO. : 5,567,168

DATED : October 22, 1996

INVENTOR(S) : Edward K. Marsh et al.

It is certified that error appears in the above-identified patent and that said Letters Patent is hereby corrected as shown below:

In the Title Page

Item [75] line 4, replace "DeFibaugh" with --Defibaugh--.

line 5, replace "Houston" with --Belton--.

Item [73] line 2, replace "Compao" with --Compaq--.

Signed and Sealed this

Twenty-third Day of June, 1998

*Attest:*

*Attesting Officer*

BRUCE LEHMAN

*Commissioner of Patents and Trademarks*